US005179756A

United States Patent [19]

Korsen

[11] Patent Number: 5,179,756

[45] Date of Patent: Jan. 19, 1993

[54] MAGNETIC PICK UP BAR FOR VACUUM CLEANERS

[76] Inventor: David W. Korsen, 6053 Corporal La., Boise, Id. 83704

[21] Appl. No.: 776,218

[22] Filed: Oct. 15, 1991

[51] Int. Cl.[5] ..... A47L 9/00; B03C 1/30

[52] U.S. Cl. ..... 15/246; 15/257 A; 15/339; 209/215

[58] Field of Search ..... 15/339, 257 A, 246; 209/636, 215

[56] References Cited

U.S. PATENT DOCUMENTS 2,847,084 8/1958 Wolfskill et al. ..... 15/339 X
4,279,745 7/1981 Haase ..... 15/339 X
4,300,260 11/1981 Hill ..... 15/339
4,759,095 7/1988 Hoy ..... 15/339
5,052,074 10/1991 Korsen ..... 15/339

*Primary Examiner*—Chris K. Moore
*Attorney, Agent, or Firm*—Paul R. Horton

[57] ABSTRACT

A magnetic pick up bar for vacuum cleaners made of flexible material to prevent marring and disfigurement of furniture, appliances, and the like, with which it may make contact and covered with a flexible plastic to prevent unwanted marking, streaking and staining of the furniture and appliances. An attachment of hook-loop material between the magnetic pickup bar and the vacuum cleaner provides secure engagement, yet permits ready removal of the bar for cleaning purposes.

8 Claims, 1 Drawing Sheet

MAGNETIC PICK UP BAR FOR VACUUM CLEANERS

BACKGROUND OF THE INVENTION

1. Field of the Invention

This invention relates to magnetic pick up devices for vacuum cleaners and, more particularly, to magnetic bars having a flexible magnetic body portion and covering to prevent marring and marking of furniture and appliances.

2. Description of the Prior Art

It is important that magnetic pick up devices for vacuum cleaners be flexible to prevent marring and disfigurement of appliances and furniture for both home and office. To this and, several devices have been created as typified by U.S. Pat. No. 4,006,512, issued to S. Saulson; U.S. Pat. No. 4,300,260, issued to C. D. Hill; and the now pending application Ser. No. 646,837, of the present inventor, D. Korsen.

There are two primary problems with the magnetic bars of the above identified inventors. Although the inventions include a flexible magnetic bar made of rubber, neoprene, and other "soft" materials, embedded with magnetized material, and therefore do not mar furniture upon contact, such bars often place marks, stains, streaks, and otherwise blotch furniture and appliances contacted. Such marks are unsightly and often difficult and time consuming to remove. A second problem is that of cleaning the bars because of their means of attachment to the vacuum cleaner. Presently, bars are attached by bolts, as suggested by Saulson; or by two sided tape; or by magnetic force alone. Such means of attachment either make the bar difficult to remove for cleaning and require tools, cannot be replaced without replacing adhesive; or simply do not hold securely as where held by magnetism alone.

SUMMARY OF THE INVENTION

The present invention overcomes these problems in the prior art by providing a magnetic bar having a rubber, neoprene, or other "soft" body portion and a covering for the body portion of a flexible mark-resistant material such as plasticized polyvinyl chloride; and by further providing a hook-loop attachment for attaching the magnetic bar to the housing of the vacuum cleaner. Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
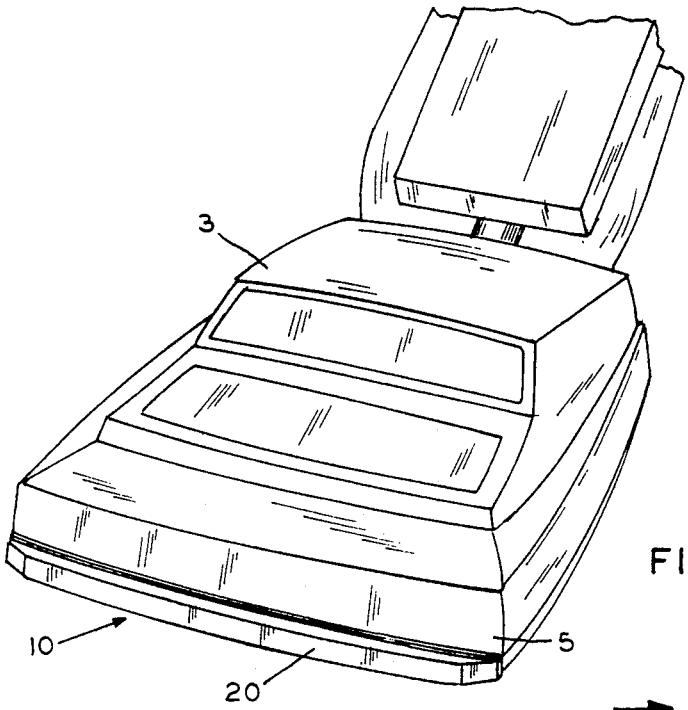
FIG. 1 is a perspective view of the magnetic bar of the present invention, shown attached to the front housing of a vacuum cleaner.
Figure 2:
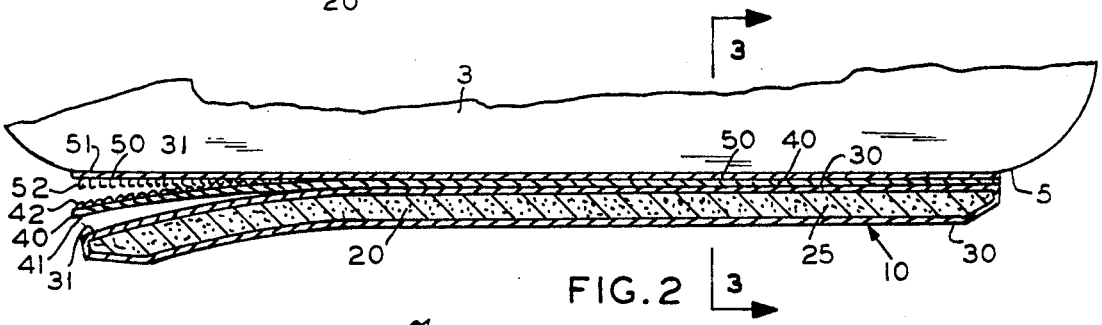
FIG. 2 is a plan view of the device of FIG. 1, showing partial disengagement from the housing for purposes of clarity.
Figure 3:
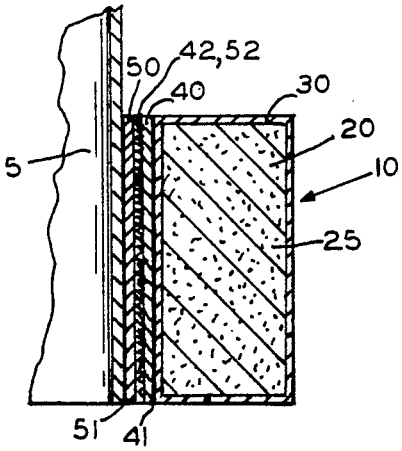
FIG. 3 is a cross sectional view taken along lines 3—3 of FIG. 2.

Referring now to the drawings, an embodiment to be preferred of a magnetic bar device 10, made according to the present invention is disclosed. Device 20 includes a flexible magnetic bar 20; a flexible mark-resistant covering 30; and a pair of mating hook and loop strips 40 and 50.

Bar 20 includes a body portion 25 constructed of neoprene, rubber, plastic, or other soft material impregnated with magnetic ferrous metal. Such material is flexible enough and resilient enough so as to prevent marring of furniture or appliances upon coming into contact therewith by accidental bumping by a vacuum cleaner 3. The body is rectangular in cross section and preferably beveled at the ends to prevent for ready deflection from objects with which it might come into contact.

To prevent the body 25 from coming directly into contact with furniture and other objects, the bar is provided with a flexible covering 30 which envelopes the body. Covering 30 is preferably made of plasticized polyvinyl chloride, ie., PVC. Shrink tubing made of such PVC is the preferred covering for east construction of the product as well as the aesthetics of the product. Once brought to the sufficient temperature, while surrounding the body 25, covering 30, when made of shrink tubing, collapses about the body to the precise shape and fit of the body. The PVC covering prevents the body 25 from making contact marks or streaks on the furniture, while not detracting noticeably from the pick-up ability of the bar. The covering 30 also presents a smooth surface for convenient cleaning of the bar.

Affixed to the rear outer surface 31 of covering 30 is a strip 49 of either hook or loop material, commonly marketed under the trademark Velcro®. Strip 40 is provided on one side 41 with a surface of adhesive for adherence to surface 31 of covering 30 and is provided on the opposing side with fabric having a multiplicity of loops 42.

Affixed to housing 5 of vacuum cleaner 3 adjacent the lowermost front end of the housing is a mating strip of Velcro® 50. Strip 50 is provided on one side 51 with a surface of adhesive for adherence of the strip to the housing and is provided on the opposing side with fabric having a multiplicity of hooks 52, operable to engage loops 42 of strip 40 for attachment of magnetic bar 20 to the vacuum cleaner. It is obvious that strips 40 and 50 may be interchanged, one for the other.

For permanent attachment of Velcro® strip 50 to housing 5, a protective strip of paper, not shown, is peeled from the strip to expose the adhesive. The paper is then discarded and the adhesive side 51 of the strip pressed into binding contact with the housing, leaving the multiplicity of hooks of the strip outwardly exposed. The loops 42 of strip 40 are then brought into contact with the hooks of strip 50, once aligned, to hold bar 20 temporarily but securely in place. To remove magnetic debris picked up by the bar or to otherwise clean the bar, one simply peels the bar away from attachment strip 50 with the loops and hooks of the Velcro® strips disengaging one another. Because of the smooth, flexible, covering 30, the bar is readily cleaned.

Having thus described in detail a preferred embodiment of the present invention, it is to be appreciated and will be apparent to those skilled din the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the mean-ing and range of equivalency of the claims are therefore to be embraced therein.

I claim:

1. A magnetic pick up device for a vacuum cleaner comprising:

an elongated bar having a body portion constructed of flexible magnetized material to prevent deforming of objects with which it may make contact; and having a flexible covering of mark-resistant material to prevent discoloring of objects with which said bar makes contact.

2. The device as described in claim 1 wherein said covering comprises a plasticized material.

3. The device as described in claim 2 wherein said covering comprises polyvinyl chloride.

4. The device as described in claim 3 wherein said covering is made of shrink tubing.

5. The device as described in claim 1 further comprising a first attachment strip of hook-loop material affixed to a back surface of said bar and a second attachment strip of mating hook-loop material affixed to the housing of a vacuum cleaner for temporarily but securely affixing said bar to a vacuum cleaner.

6. A magnetic pick up device for a vacuum cleaner comprising:

an elongated bar having a body portion constructed of flexible magnetized material to prevent deforming of objects with which it may make contact; and having a flexible plasticized covering of mark-resistant shrink tubing to prevent discoloring of objects with which said bar makes contact.

7. The device as described in claim 6 further comprising a first attachment strip of hook-loop material affixed to a hook surface of said bar and a second attachment strip of mating hook-loop material affixed to the housing of a vacuum cleaner for temporarily but securely affixing said bar to a vacuum cleaner.

8. A magnetic pick up device for a vacuum cleaner comprising:

an elongated bar having a body portion constructed of flexible magnetized material to prevent deforming of objects with which it may make contact; and having a flexible plasticized covering of mark-resistant material to prevent discoloring of objects with which said bar makes contact; a first attachment strip of hook-loop material affixed to a back surface of said bar; and a second attachment strip of mating hook-loop material affixed to the housing of a vacuum cleaner for temporarily but securely affixing said bar to a vacuum cleaner.

* * * * *